US005399036A

United States Patent [19]

Yamaguchi

[11] Patent Number: 5,399,036

[45] Date of Patent: Mar. 21, 1995

[54] TAPE TAKING-UP MECHANISM

[75] Inventor: Koshiro Yamaguchi, Kasugai, Japan

[73] Assignee: Brother Kogyo Kabushiki Kaisha, Nagoya, Japan

[21] Appl. No.: 171,404

[22] Filed: Dec. 22, 1993

[30] Foreign Application Priority Data

Jan. 29, 1993 [JP] Japan ..... 5-014265

[51] Int. Cl.[6] ..... B41J 33/24

[52] U.S. Cl. ..... 400/236; 400/234; 400/236.2

[58] Field of Search ..... 400/227.2, 234, 236, 400/236.1, 236.2

[56] References Cited

U.S. PATENT DOCUMENTS 4,231,667 11/1980 Behreudt et al. ..... 400/227.2
4,440,514 4/1984 Keiter et al. ..... 400/227.2
4,611,937 9/1986 Sato et al. .
4,927,278 5/1990 Kuzuya et al. .
4,966,476 10/1990 Kuzuya et al. .

FOREIGN PATENT DOCUMENTS 1207665 10/1970 United Kingdom .

OTHER PUBLICATIONS

Japan Abstracts, vol. 11, No. 135 (M-585) (2582) Apr. 28, 1987, JP-61-274975.
Japan Abstracts, vol. 8, No. 201 (M-325) (1638) Sep. 14, 1984, JP-59-091087.

*Primary Examiner*—Edgar S. Burr
*Assistant Examiner*—Lynn D. Hendrickson
*Attorney, Agent, or Firm*—Oliff & Berridge

[57] ABSTRACT

A first power transmitting shaft is fitted to a second power transmitting shaft in such a manner as to be freely rotated independently of each other, The first power transmitting shaft is applied to a cartridge provided with a wide ribbon taking-up spool while the second power transmitting shaft 56 is applied to a cartridge provided with a narrow ribbon taking-up spool. First engaging portions engage with the locking grooves formed near the tip end on the inner circumference of the wide ribbon taking-up spool and are disposed on the outer periphery at the tip end of the first power transmitting shaft while second engaging portions engage with the locking grooves formed near the base end on the inner circumference of the narrow ribbon taking-up spool and are disposed on the outer periphery at the tip end of the second power transmitting shaft. Clutch springs are wound around the first power transmitting shaft and the second power transmitting shaft, respectively, for generating adequate slide torque.

14 Claims, 8 Drawing Sheets

TAPE TAKING-UP MECHANISM

BACKGROUND OF THE INVENTION

1. Field of the Invention

The invention relates to a device for taking up tapes, such as an ink ribbon used in a printer or the like or a magnetic tape for recording sounds or images, of various widths where the tapes are incorporated in a detachable cartridge.

2. Description of Related Art

The applicant of the invention has proposed, in U.S. Pat. Nos. 4,927,278 and 4,966,476, a cartridge used in a tape writer for making a label tape or the like for label display. The cartridge is detachably disposed in a printer, e.g., in a tape writer, where an arbitrary character or symbol is input to be printed on a print tape, such as a transparent film made of a synthetic resin, by a print unit of the printer while being drawn out of the cartridge.

The cartridge consists of a case unit and a cover both made of a synthetic resin. Inside the case unit are housed a winding container for a print tape, a winding container and taking-up unit for an ink ribbon, and a winding container for a double-sided adhesive tape with a peelable sheet stuck onto one side thereof. The ink ribbon and the print tape are drawn out of a feed outlet discharging portion formed in the cartridge with an inked surface of the ink ribbon and the inner surface of the print tape mating with each other. The ink ribbon is fed to face a print head while being held together with the print tape between a rotatable platen and the stationary thermal printhead disposed in the vicinity of a feed outlet. Ink is printed on the inner surface of the print tape, as a mirror image, on the basis of the pattern of a character, or characters, which has been input through the print unit of the printer.

The printed ink ribbon is drawn again into the cartridge, downstream in a feed direction of the print unit, to be taken up by the taking-up unit.

Meanwhile, an exposed adhesive surface on one side of the double-sided adhesive tape is adhered to the print tape in such a manner as to be adhered to the inked surface downstream of the print unit in the feed direction and the tape is drawn out of the tape writer and cut off.

It is necessary to change the width of the print tape according to the size of the object to which the tape is to be mounted or the size of the character(s) to be printed, thus requiring wide and narrow ink ribbons accordingly. The tape and ink ribbon need be contained in a cartridge of a width larger than that of the tape and ink ribbon. The taking-up unit of the ink ribbon must take up the ink ribbon by applying a torque according to the width of the ribbon.

However, the torque generated in the conventional taking-up unit is constant. In the case where the cartridge incorporating a narrow ink ribbon is disposed in the taking-up unit that generates torque suitable for a wide ink ribbon, the narrow ink ribbon is easily broken. On the other hand, if the cartridge incorporating a wide ink ribbon is disposed in the taking-up unit that generates a torque suitable for a narrow ink ribbon, the wide ink ribbon cannot be taken up due to the lack of torque.

SUMMARY OF THE INVENTION

To solve the above described problem, the torque generated in the taking-up unit is set suitable to the wide ink ribbon. Meanwhile, a clutch spring, as a brake, is wound around a ribbon taking-up spool disposed in the cartridge incorporating the narrow ink ribbon therein so as to decrease the torque transmitted from the taking-up unit. Since the cartridge is a disposable one which is thrown away when the printing tape is consumed, the manufacturing cost is increased due to an increase in the number of component parts if the aforementioned clutch spring is used.

This problem also applies to a cartridge incorporating only an ink ribbon and a cartridge incorporating a magnetic tape for recording sounds or images.

The invention solves the above problem observed in the prior art. An object of the invention is to generate a taking-up torque according to the width of the tape in the cartridges.

In order to achieve the above-stated object, in the tape taking-up mechanism according to the invention, provided with a detachable cartridge incorporating therein tapes, such as an ink ribbon, and spools for taking up the tapes and adapted to drive the spools, a plurality of engaging portions selectively engaged with the spools in the cartridge, which can incorporate tapes of various widths, are arranged at suitable intervals in a longitudinal direction of the spools in such a manner as to be freely turned independently of each other; and power transmitting units for transmitting various kinds of driving forces from a drive source in the taking-up mechanism are disposed continuously to the engaging portions. Consequently, even if the cartridge is replaced with one having a tape of a different width, it is possible to prevent the accidental cutting and deficient winding of the tape. As a result, a plurality of cartridges having tapes of various widths can be used in only one tape taking-up mechanism without any difficulty. Furthermore, it is unnecessary to provide a complicated torque generating device for each cartridge, with the attendant advantage of reduced manufacturing costs of the disposable cartridges.

DETAILED DESCRIPTION OF THE PREFERRED EMBODIMENT

Figure 1:
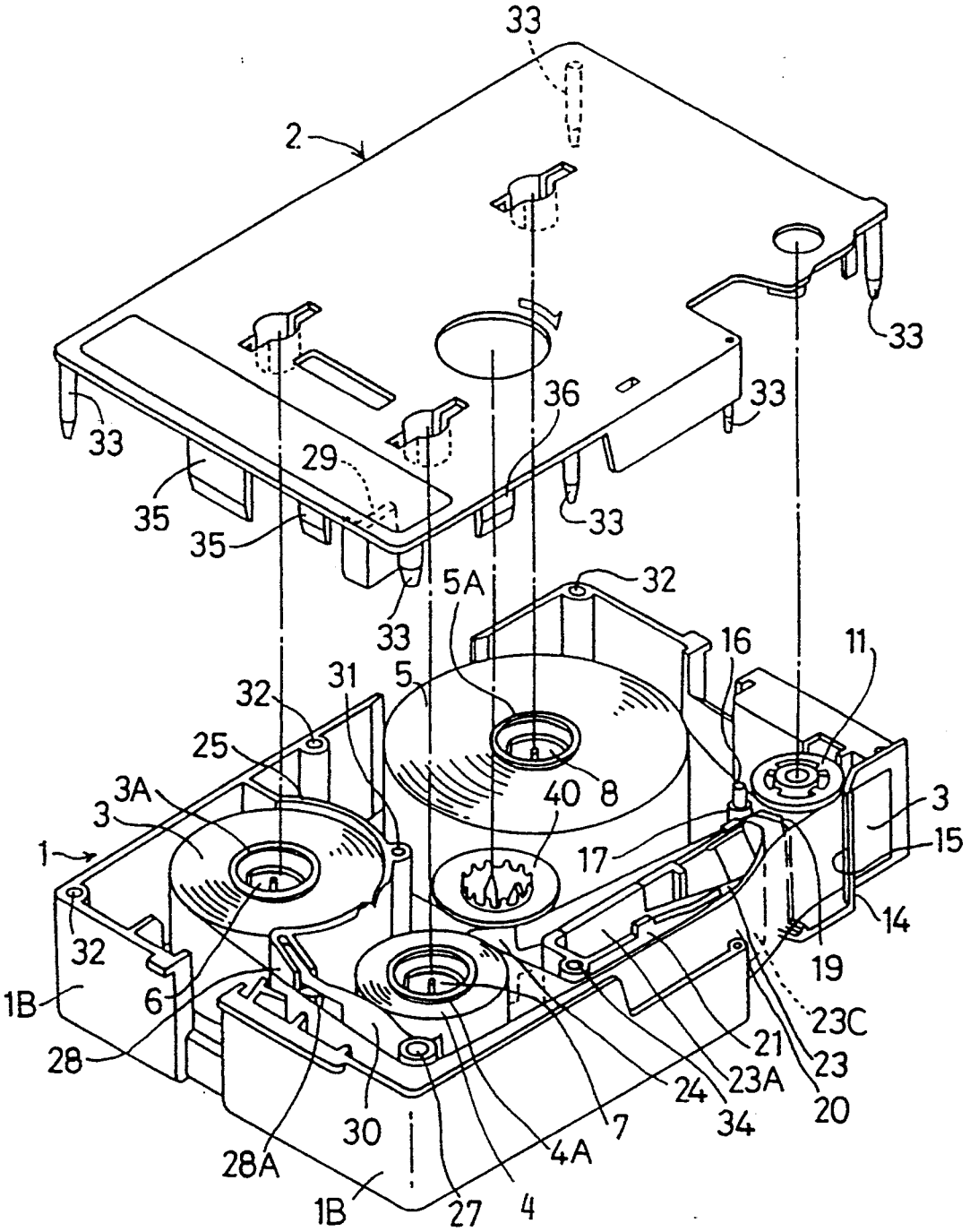
FIG. 1 is an exploded perspective view showing a case unit containing a print tape or the like, and a cover according to the invention.
Figure 2:
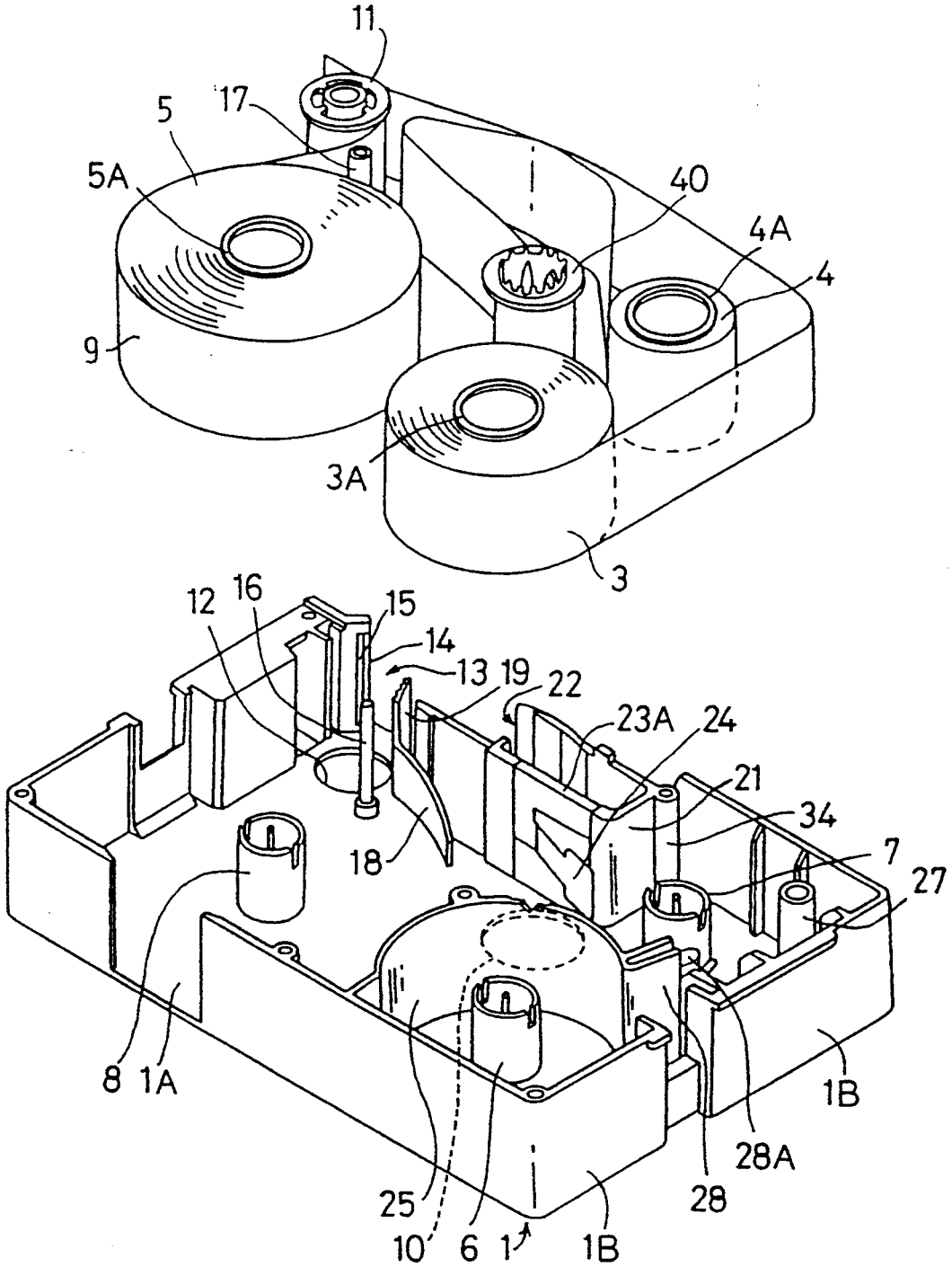
FIG. 2 is a perspective view showing a state before the print tape or the like are disposed in the case unit.
Figure 3:
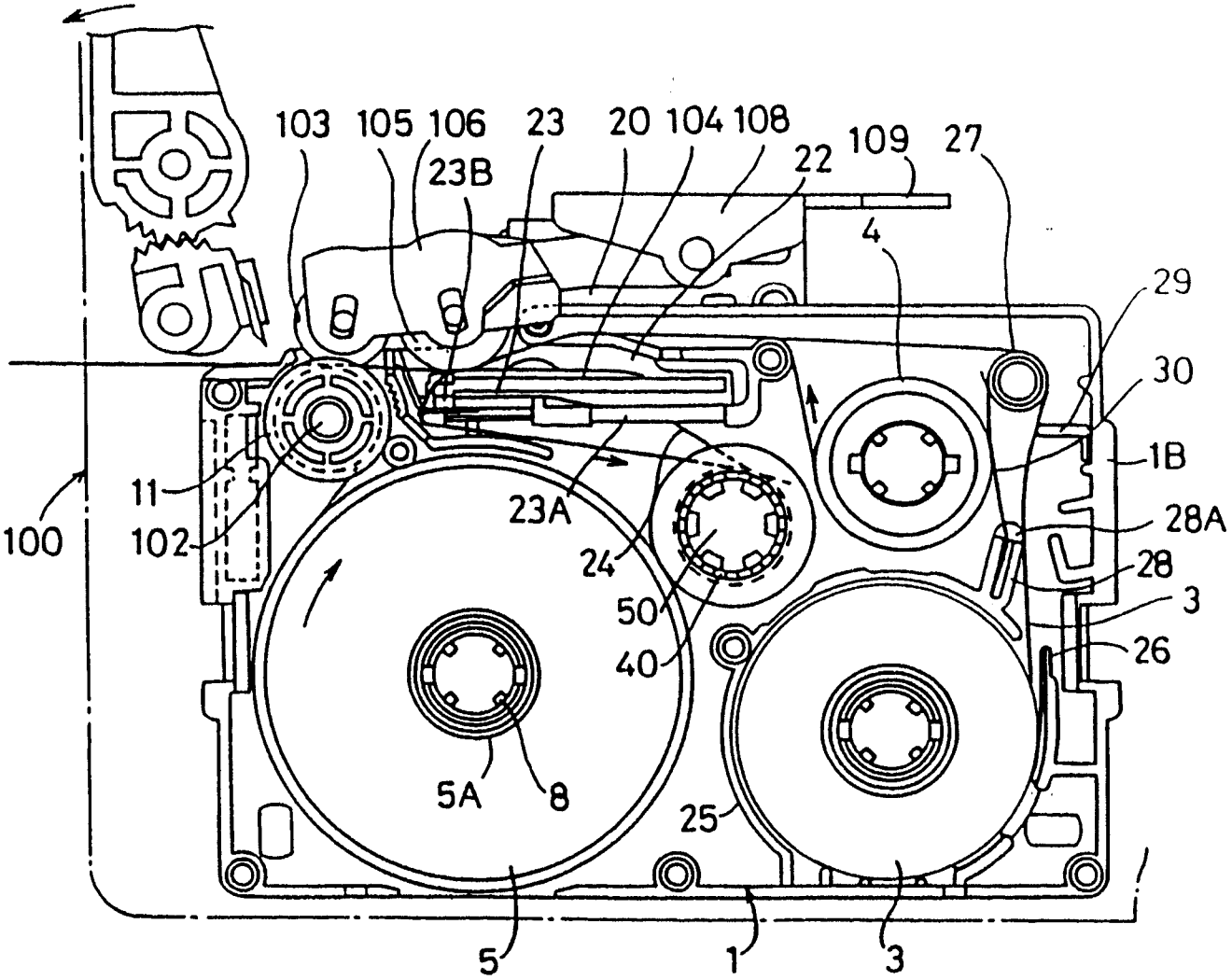
FIG. 3 is a view showing the cartridge mounted in a printer.

Hereafter, the invention will be described more particularly by way of a tape taking-up mechanism embodying the invention. A cartridge is made up of a case unit 1 opened at the upper surface thereof and a plate-like cover 2 for covering the upper surface of the case unit 1. The case unit 1 and the cover 2 are both made of a synthetic resin by injection molding. FIG. 1 is an exploded perspective view showing the case unit 1, containing therein a print tape 3, an ink ribbon 4 and a double-sided adhesive-tape 5, and the cover 2; FIG. 2 is a perspective view showing a state before the print tape 3, the ink ribbon 4 and the double-sided adhesive tape 5 are disposed in the case unit 1; and FIG. 3 is a view showing the cartridge mounted in a printer 100 with the cover 2 detached therefrom.

As illustrated in FIG. 2, cylindrical fitting shafts 6,7,8 extend from the bottom plate la of the case unit 1. A spool 3A of the print tape 3 is rotatably supported by the fitting shaft 6, thus constituting a winding container for the print tape 3. A spool 4A of the ink ribbon 4 is rotatably supported by the fitting shaft 7, thereby forming a winding container for the ink ribbon 4. A spool 5A of the double-sided adhesive tape 5, where a peelable sheet 9 is adhered to one side (radially outside of a winding container), is rotatably supported by the fitting shaft 8, thereby constructing the winding container for the double-sided adhesive tape 5.

A taking-up spool 40 for the ink ribbon 4 is rotatably supported at a position of a bearing hole 10 bored at the bottom plate 1A of the case unit 1. A driving shaft portion 51 of a ribbon taking-up mechanism 50 (FIG. 4), having a later-described structure, disposed in the printer 100, is fitted to the inner diameter portion of the taking-up spool 40 so as to take up the ink ribbon 4.

Figure 4:
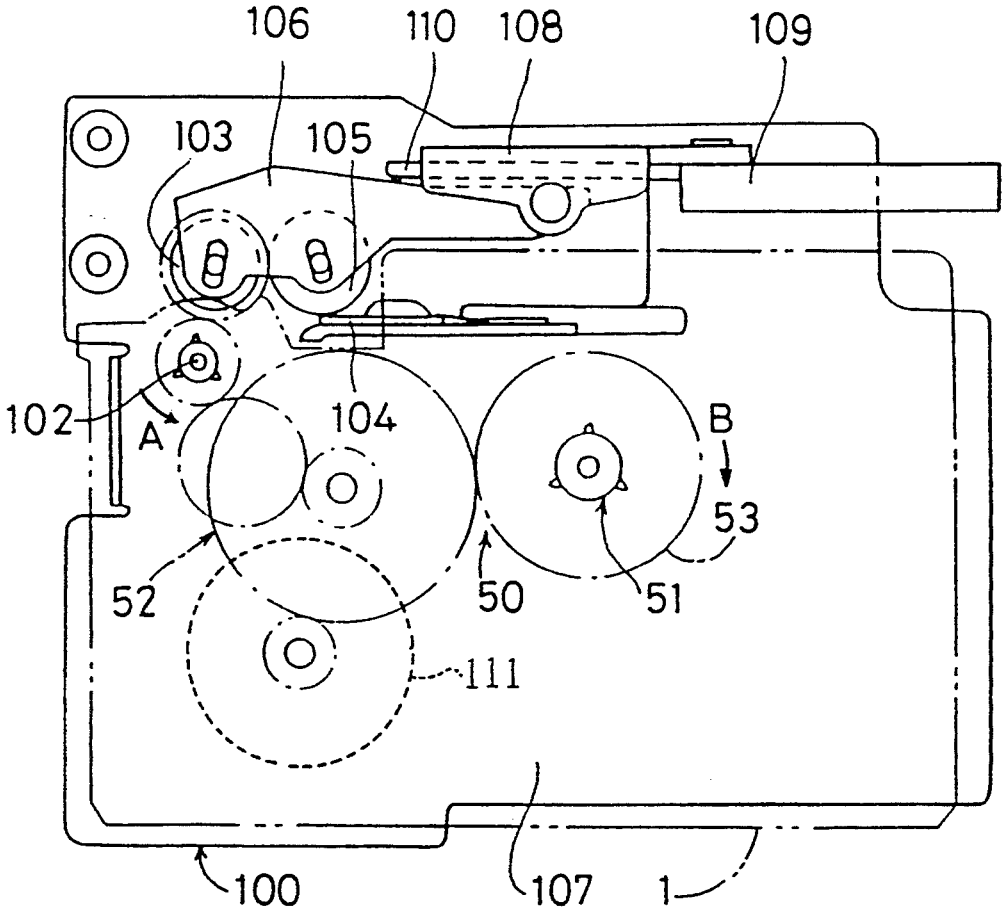
FIG. 4 is a front view showing the printer and a taking-up mechanism.

A feed roller 11 for feeding the double-sided adhesive tape 5 to the exterior is rotatably supported in another bearing hole 12 formed on the bottom plate 1A. The feed roller 11 is drivingly rotated by a feed-out driving shaft 102 projected from the printer 100 (FIG. 4).

The shape of the case unit 1A is as follows. The feed roller 11 is disposed in an opening 13 formed by cutting one side of the surrounding wall 1B of the case unit 1A in such a manner as to be exposed in a part of the circumferential surface thereof. The double-sided adhesive tape 5 is fed in such a state that the peelable sheet 9 stuck onto one side thereof is in contact with the circumference of the feed roller 11. The print tape 3, after being printed in a print unit later described, and the double-sided adhesive tape 5 are fed between a driving roller 103 (FIG. 3) in the printer 100 and the feed roller 11. The tapes 3,5 are fed, in a state such that they are bonded to each other, from the printer 100 through a tape hole 15 defined by a tape presser 14 disposed sideways of the opening 13. A guide roller 17 made of silicone rubber is rotatably fitted to a spindle 16 extending from the bottom plate 1A in such a manner as to face the feed roller 11, thereby preventing an adhesive surface of the double-sided adhesive tape 5, which is discharged to the exterior through the opening 13, from being brought into contact with a curved separation wall 18, where a plurality of contact retardant projections are formed in a portion facing the feed roller 11.

Formed adjacent to the opening 13 is a taking-up inlet 19 for the ink ribbon 4 with the curved separation wall 18 interposed between the opening 13 and the taking-up inlet 19. A circumferential wall 21 having a substantial U-shape, in plan view, is provided for obtaining a feed outlet 20 for the ink ribbon 4 and the print tape 3. A thermal head 104 of the printer 100 is contained in a space 22 surrounded by the circumferential wall 21. A plate spring 23 extending toward the taking-Up inlet 19 at the curved tip end 23B thereof inside the space 22 is fixed to the circumferential wall 21 by inserting a base end 23A having a U-shaped cross section. The print tape 3 and the ink ribbon 4 are discharged from the feed outlet 20 so as to be laid in superposition at the curved tip end 23B of the plate spring 23.

In disposing the cartridge in the printer 100, an inclining side portion 23C of the plate spring 23 is pressed against the lower surface of the thermal head 104 upon insertion of the thermal head 104 into the space 22 so that the thermal head 104 is interposed between the lower surface of the ink ribbon 4 and the plate spring 23, and the print tape 3 and the ink ribbon 4 are held in a holding portion between the thermal head 104 and a rotatable platen roller 105.

As depicted in FIG. 4, the driving roller 103 and the platen roller 105 are fixed to an oscillating arm 106, the base end of which is rotatably pivoted in a bracket 108 erected on a frame 107 in the printer 100, to be urged in a direction separated from the thermal head 104 by a spring means, not shown. After disposition of the cartridge, the platen roller 105 is rotated to be pressed against the thermal head 104 via a link mechanism 110 upon turning of an operating lever 109.

A plate spring 24, that prevents looseness by being pressed against the ink ribbon 4 being taken up in the taking-up spool 40, is exposed at the tip end thereof to the inside of the case unit 1 in a direction opposite to the plate spring 23 inserted into a space surrounded by the circumferential wall 21.

The feed path of the print tape 3 inside the case unit 1 consists of the print tape 3 being taken out of a groove 26 cut at the tip end of a partition wall 25, formed into a curve in plan view for partitioning the winding container of the print tape 3 and the winding container of the ink ribbon 4, and passed along the inside of the circumferential wall 1B of the case unit 1 to be fed toward the feed outlet 20 after being turned 90°, in plan view, at the circumferential surface of a cylindrical guide portion 27 erected at a corner on the bottom plate 1A.

A projection 28A of a rib 28, extending radially outward from the partition wall 25 in the vicinity of the cut groove 26, the circumference of the cylindrical guide portion 27, and a longitudinal tip end of a rib 29 projecting downward from the lower surface of the cover 2 between the projection 28A and the cylindrical guide portion 27 constitute an obstacle made of a non-elastic material for non-linearly bending the feed path for the print tape 3 (see FIG. 3) and applying feed resistance to the print tape 3 as it is drawn out of the cartridge. Accordingly, back tension is applied to the print tape 3 so as to prevent looseness.

A plate spring 30 has a base end inserted into the rib 28 and a tip end supported by the cylindrical guide portion 27. The intermediate portion of the plate spring 30 is brought into contact with the ink ribbon 4 in the winding container, thereby applying back tension. As illustrated in FIG. 1, at the inner surface of the cover 2 and projecting downward are fitting pins 33 to be fitted to fitting struts 31, 32 that project from the bottom plate of the case unit 1 or are formed on the inner surface of the circumferential wall 1B. Moreover, since the guide walls 35,36 that project downward at the circumferential edge of the cover 2 are formed along the inner surface of the circumferential wall 1B of the case unit 1, the cover 2 can be fixed to the case unit 1 without any positional error.

Figure 5:
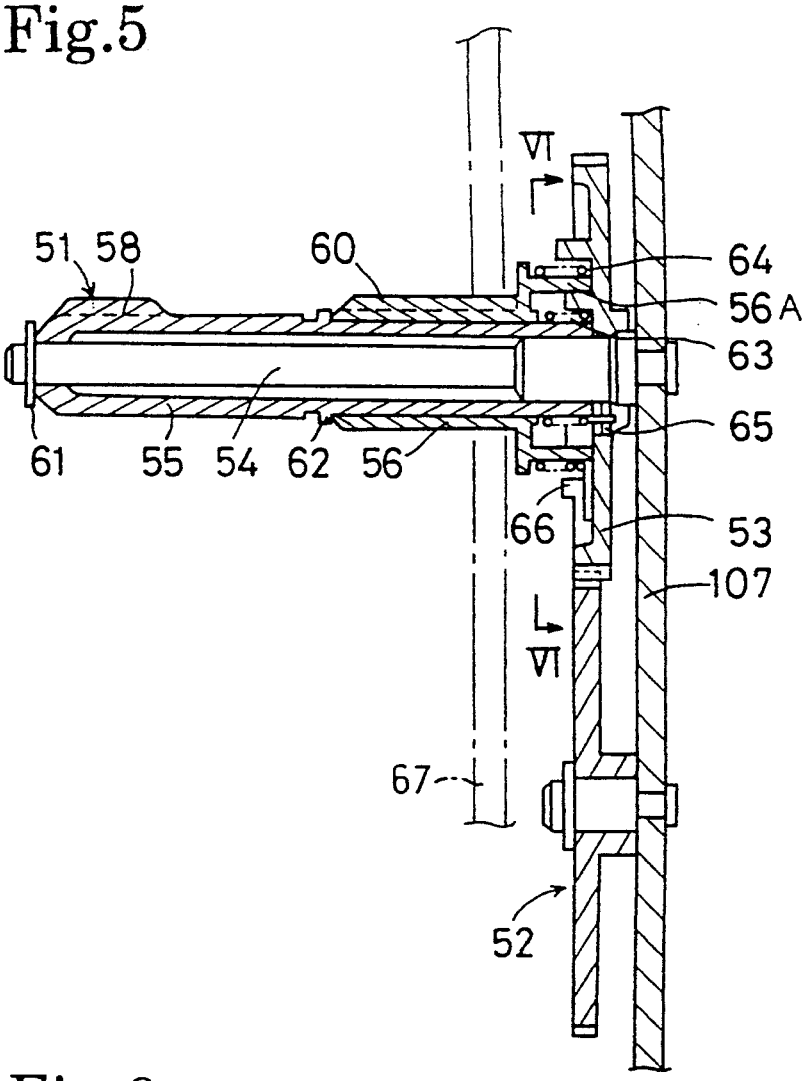
FIG. 5 is a cross sectional view showing the taking-up mechanism.
Figure 6:
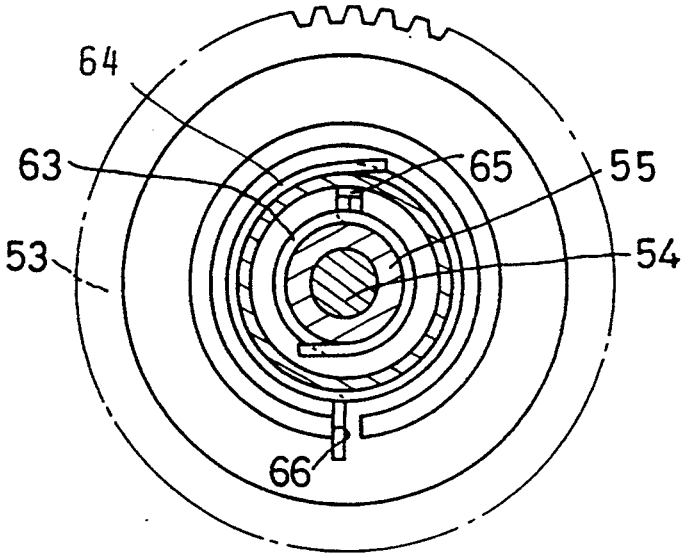
FIG. 6 is a view taken along the line VI—VI of FIG. 5.

The ribbon taking-up mechanism 50 according to the invention will be explained in more detail. As shown in FIGS. 4 through 6, a driving force is applied by a driving motor 111 disposed on the back of the frame 107 of the printer 100 to rotate the feed-out driving shaft 102 in a direction indicated by an arrow A in FIG. 4 and to rotate a driving gear 53 of the ribbon taking-up mechanism 50 in a direction indicated by an arrow B in FIG. 4 via a transmitting gear train 52 disposed on the obverse of the frame 107.

The driving gear 53 is rotatably supported by the base portion of a center shaft 54 that projects from the frame 107. A first power transmitting shaft 55 is rotatably fitted to the center shaft 54 while a second power transmitting shaft 56 is rotatably fitted around the shaft 55, where both of the shafts 55,56 are coaxial with each other and rotatable independently of each other.

Figure 7:
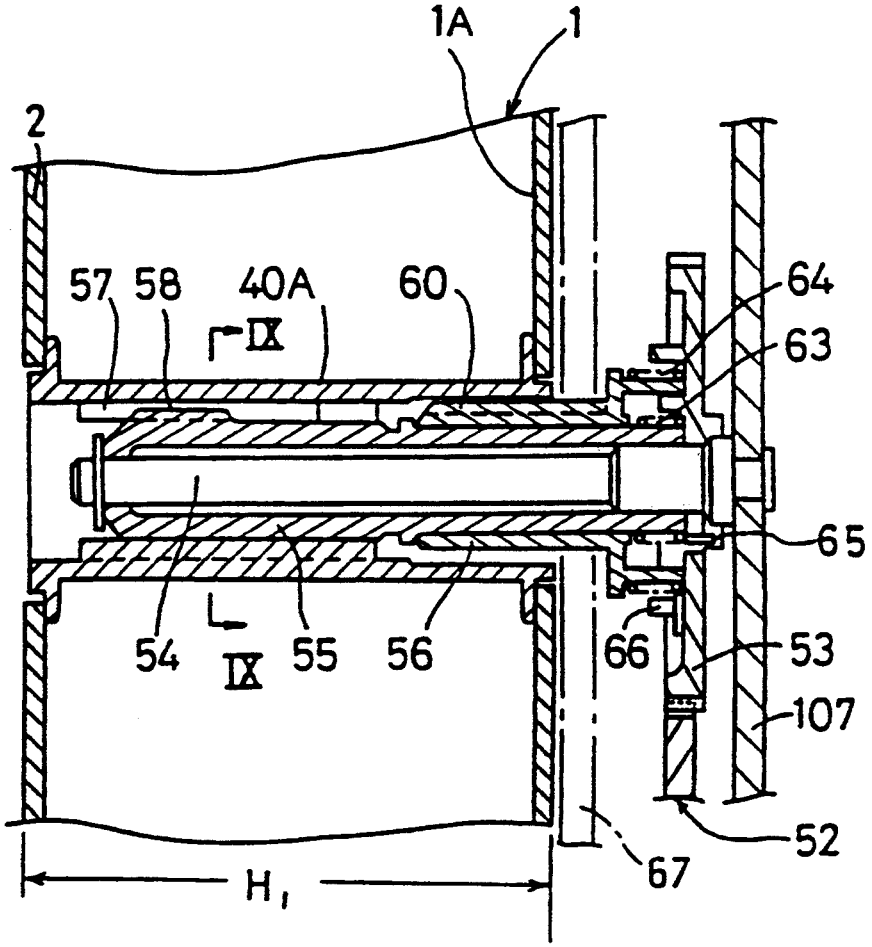
FIG. 7 is a cross sectional view of assistance in explaining a state where a cartridge for a wide ink ribbon is used.
Figure 8:
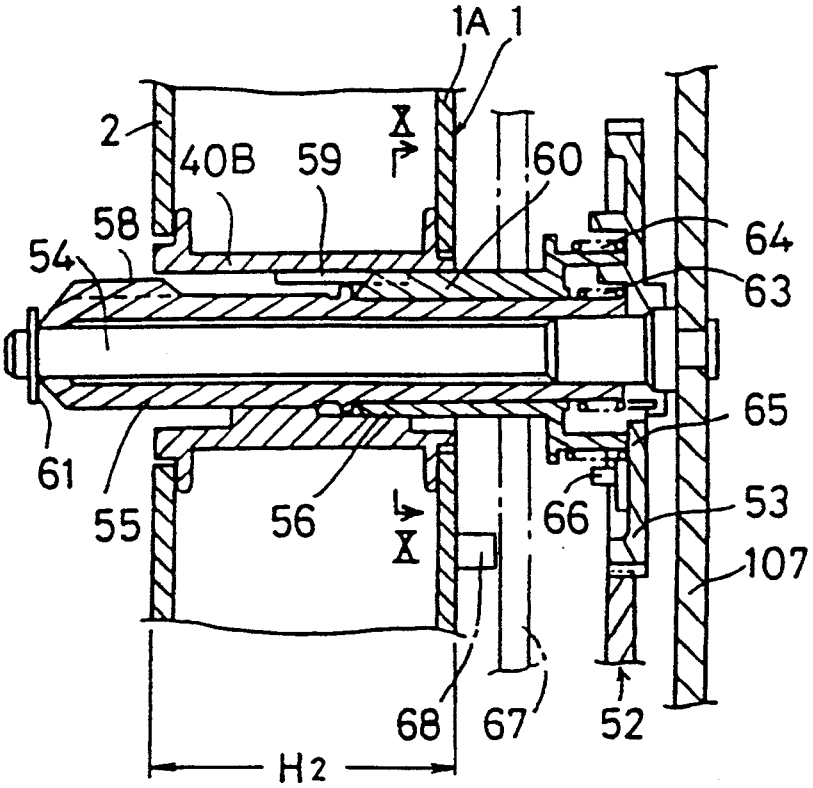
FIG. 8 is a cross sectional view of assistance in explaining a state where a cartridge for a narrow ink ribbon is used.

The first power transmitting shaft 55 is applied to a cartridge provided with a taking-up spool 40A having a wide dimension Hi as depicted in FIG. 7. Meanwhile, the second power transmitting shaft 56 is applied to a cartridge provided with a taking-up spool 40B having a narrow dimension H2 as shown in FIG. 8. Consequently, the first power transmitting shaft 55 is formed longer than the second power transmitting shaft 56 as illustrated in FIG. 5. A plurality of first engaging portions 58 engageable with only locking grooves 57 projectedly formed in portions near the inner circumferential tip end of the taking-up spool 40A are projected radially outward on the outer periphery at the tip end of the first power transmitting shaft 55 (see FIG. 9). A plurality of second engaging portions 60 engageable with only locking grooves 59 projectedly formed in portions near the inner circumferential base end of the taking-up spool 40B are projected radially outward on the outer periphery at the tip end of the second power transmitting shaft 56 (see FIG. 10).

A stop ring 61 is attached to the center shaft 54 so as to prevent the first power transmitting shaft 55 from being accidentally shifted. Meanwhile, a projection 62 formed on the first power transmitting shaft 55 is adapted to prevent the second power transmitting shaft 56 from being erroneously shifted. As a result, the first engaging portions 58 and the second engaging portions 60 are positioned at suitable intervals in the longitudinal direction of the center shaft 54, i.e., of the taking-up spools 40A and 40B.

As shown in FIGS. 5 and 6, a coil-like clutch spring 63, serving as a first power transmitting unit, for transmitting adequate driving force (torque) from the driving gear 53 to the first power transmitting shaft 55 in the taking-up mechanism 50 is wound at the coil portion thereof in contact around the first power transmitting shaft 55 while it is locked at one end thereof in a locking portion 65 such as a locking hole of the driving gear 53. In the same manner, a coil-like clutch spring 64, serving as a second power transmitting unit, for transmitting adequate driving force (torque) from the driving gear 53 to the second power transmitting shaft 56 in the taking-up mechanism 50 is wound at the coil portion thereof in contact around the outer periphery 56A of the base end cylinder of the second power transmitting shaft 56 while it is locked at one end thereof in a locking portion 66 such as a locking groove of the driving gear 53.

As illustrated in FIG. 6, the coil portions of the clutch springs 63 and 64 are wound in such a direction that the driving gear 53 is rotated rightward if the first and second power transmitting shafts 55 and 56 are fixed. The clutch springs 63 and 64 are provided with two functions: (1) of absorbing a difference between an amount of the ink ribbon which is fed ,out in the print unit and taking-up amounts caused by the magnitude of taking-up diameters generated in the ribbon taking-up spools 40A and 40B by a slip between the coil portions of the clutch springs and the shaft portion of the first power transmitting shaft 55 or the second power transmitting shaft 56 in slide-contact with the coil portions; and (2) of taking up the ink ribbon after print operation by the slide torque generated when the absorbing function is executed.

The slide torque is set in such a manner as to be large in the clutch spring 63 applied to the cartridge containing the wide ink ribbon and to be small in the clutch spring 64 applied to the cartridge containing the narrow ink ribbon.

Figure 9:
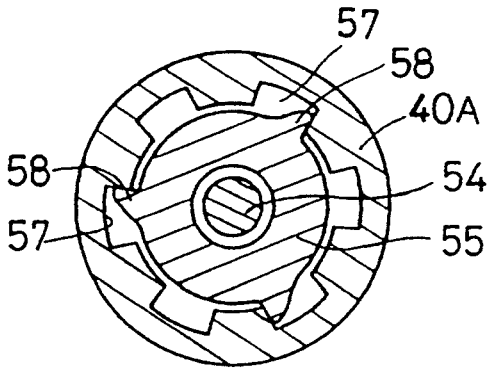
FIG. 9 is a view taken along the line IX—IX of FIG. 7.

In disposing the cartridge containing the wide ink ribbon in the printer 100, the engaging portions 58 of the first power transmitting shaft 55 are engaged with the locking grooves 57 of the ribbon taking-up spool 40A, not with the engaging portions 60 of the second power transmitting shaft 56, as illustrated in FIGS. 7 and 9. If print operation is carried out in this state, the feed-out driving shaft 102 and the driving gear 53 are rotated in the predetermined direction, respectively, by the driving motor 111 so that the print tape 3 and the ink ribbon 4 are fed toward the thermal head 104. The print tape 3 and the double-sided adhesive tape 5 are bonded together at the position of the feed roller 11 after the print operation to be thus discharged to the exterior of the printer. Meanwhile, the ink ribbon 4, after the print operation, is taken up by the taking-up spool 40A that is rotated integrally with the first power transmitting shaft 55. At this moment, the first power transmitting shaft 55 generates the necessary slide torque required to take up the wide ink ribbon at the position of the clutch spring 63, so that the first power transmitting shaft 55 rotates at a different rotating speed than that of the driving gear 53.

Figure 10:
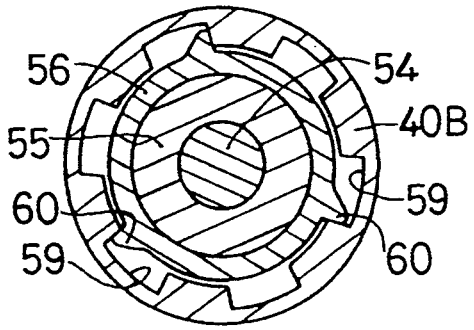
FIG. 10 is a view taken along the line X—X of FIG. 8.

On the other hand, if the cartridge containing the narrow ink ribbon is disposed in the printer 100, the engaging portions 60 of the second power transmitting shaft 56 are engaged with the locking grooves 59 of the ribbon taking-up spool 40B, not with the engaging portions 58 of the first power transmitting shaft 55, as illustrated in FIGS. 8 and 10. If the print operation is carried out in this state, the ink ribbon 4, after the print operation, is taken up by the taking-up spool 40B rotated integrally with the second power transmitting shaft 56. At this time, the second power transmitting shaft 56 generates a preset slide torque necessary for taking up the narrow ink ribbon at a position of the clutch spring 64, so that the second power transmitting shaft 56 rotates at a different rotating speed than that of the driving gear 53.

When the cartridge having a wide ink ribbon is replaced with one containing an ink ribbon of a narrow width, at least one projection 68 formed in the case unit 1 holding a narrow tape restricts the insertion depth of the cartridge into the first power transmitting shaft 55 or the second power transmitting shaft 56 in such a manner that the taking-up spool according to the width of the ink ribbon is selectively engaged with the first engaging portions or the second engaging portions (see FIGS. 7 and 8).

Alternatively, the projection or projections 68 may be provided on the support plate 67 (not shown). When this is the case, the cartridge having a wide ink ribbon has a receptacle (not shown) for receiving the projection(s) 68 so that the case unit 1 is seated against the support plate 67. When the cartridge has a narrow ink ribbon, then the outer surface of the case unit 1 contacts the projection 68 separating the case unit 1 from the support plate 67 in the same way as shown in FIG. 8.

As is apparent from the above description, it is possible to prevent the accidental cutting or the deficient winding of the ribbon even if the cartridge is replaced with one having a ribbon of a different width because the taking-up spool according to the width is selectively engaged with the first engaging portion or the second engaging portion and the engaging portions are formed to engage with the clutch springs 63 or 64, serving as the power transmitting unit, capable of generating adequate slide torque when the cartridge is replaced with one containing an ink ribbon of a different width.

If three levels of slide torque are desired, three power transmitting shafts, each provided with a clutch spring, may be disposed coaxially with each other so as to be independently rotatable of one another and engaging portions may be formed at three different positions along the axes of the power transmitting shafts, respectively.

What is claimed is:

1. A tape taking-up mechanism provided with a detachable cartridge which incorporates tapes of various widths and spools for taking up the tapes and adapted to drive said spools, comprising:

a plurality of engaging portions freely turnable independently of each other and selectively engageable with said spools in said cartridge at intervals in a longitudinal direction of said spools in such a manner that each engaging portion contacts a different width tape;

a drive source; and power transmitting units for transmitting differing driving forces from :said drive source to said engaging portions.

2. The tape taking-up mechanism as claimed in claim 1, further comprising:

a support plate; and a projection formed on said support plate, wherein when the cartridge is a wide cartridge that holds a wide tape, the cartridge has a receptacle for receiving said projection and when the cartridge is a narrow cartridge that holds a narrow tape, a surface of the cartridge contacts said projection to space the cartridge from said support plate.

3. The tape taking-up mechanism as claimed in claim 1, further comprising:

a support plate; and a projection formed on an outer surface of the cartridge, wherein when the cartridge is a narrow cartridge containing a narrow tape, said projection contacts said support plate to space the cartridge from said support plate.

4. A tape take-up mechanism for handling tapes of varying widths, the take-up mechanism mounted in a tape using apparatus, comprising:

an apparatus frame;

a driving motor mounted to said apparatus frame;

a transmitting gear driven by said driving motor;

a driving gear meshed with said transmitting gear;

a center shaft projecting from said apparatus frame and rotatably mounted to said driving gear;

a first power transmitting shaft rotatably fitted to said center shaft;

a second power transmitting shaft rotatably fitted around said first power transmitting shaft, said first and second power transmitting shafts being coaxial to one another;

first clutch means for transmitting a driving force to said first power transmitting shaft; and second clutch means for transmitting a different driving force to said second power transmitting shaft.

5. The tape take-up mechanism as claimed in claim 4, further comprising stop means attached to an end of said center shaft for preventing said first power transmitting shaft from axially shifting position.

6. The tape take-up mechanism as claimed in claim 5, further comprising a projection formed on said first power transmitting shaft to prevent said second power transmitting shaft from axially shifting position.

7. The tape take-up mechanism as claimed in claim 5, wherein said first power transmitting shaft has a plurality of first engaging portions projecting from an outer surface at an end proximate said stop means.

8. The .tape take-up mechanism as claimed in claim 7, wherein said second power transmitting shaft has a plurality of second engaging/portions extending substantially along an entire axial length.

9. The tape take-up mechanism as claimed in claim 8, wherein said first and second engaging portions are positioned at predetermined positions along an axial direction of said center shaft so as to engage tape take-up members.

10. The tape take-up mechanism as claimed in claim 4, wherein said first clutch mechanism is a first coil spring coiled around a coil portion of said first power transmitting shaft and having an end attached to said driving gear.

11. The tape take-up mechanism as claimed in claim 10, wherein said second clutch means comprises a second coil spring coiled around a coil portion of said second power transmitting shaft and having an end attached to said driving gear.

12. The tape take-up mechanism as claimed in claim 11, wherein said first coil spring provides a greater torque than does said second coil spring.

13. The tape take-up mechanism as claimed in claim 4, further comprising:

a support plate forming a part of said apparatus frame; and a projection formed on said support plate, wherein when a cartridge housing the tape is a wide cartridge that holds a wide tape, the cartridge has a receptacle for receiving said projection and when the cartridge is a narrow cartridge that holds a narrow tape, a surface of the cartridge contacts said projection to space the cartridge from said support plate.

14. The tape taking-up mechanism as claimed in claim 4, further comprising:

a support plate forming a part of said apparatus frame wherein a projection is formed on an outer surface of a cartridge housing the tape when the cartridge is a narrow cartridge containing a narrow tape so that said projection contacts said support plate to space the cartridge from said support plate.

* * * * *